US012722674B2

(12) United States Patent
Fuglem et al.

(10) Patent No.: US 12,722,674 B2
(45) Date of Patent: Sep. 1, 2026

(54) RAILCAR FOULING DETECTION SYSTEM

(71) Applicant: Railserve, Inc., Atlanta, GA (US)

(72) Inventors: Alec Fuglem, Glenview, IL (US); Charlie Crosby, Greersferry, AR (US); Jason Neil Smith, Edmonton (CA); Marco Mattioli, Modena (IT)

(73) Assignee: Railserve, Inc., Atlanta, GA (US)

( * ) Notice: Subject to any disclaimer, the term of this patent is extended or adjusted under 35 U.S.C. 154(b) by 136 days.

(21) Appl. No.: 18/600,116

(22) Filed: Mar. 8, 2024

(65) Prior Publication Data

US 2024/0300557 A1 Sep. 12, 2024

Related U.S. Application Data

(60) Provisional application No. 63/489,229, filed on Mar. 9, 2023.

(51) Int. Cl.
*B61L 27/57* (2022.01)
*B61L 27/20* (2022.01)

(52) U.S. Cl.
CPC ..... *B61L 27/57* (2022.01); *B61L 27/20* (2022.01)

(58) Field of Classification Search
CPC ..... B61L 27/57; B61L 27/20
See application file for complete search history.

(56) References Cited

U.S. PATENT DOCUMENTS 5,821,700 A * 10/1998 Malvaso ..... H05B 39/02 340/474
6,427,973 B1 * 8/2002 Wagner ..... F16K 3/188 251/193

(Continued)

FOREIGN PATENT DOCUMENTS

DE 10 2007 038820 A1 2/2009
EP 3 275 764 A1 1/2018

(Continued)

OTHER PUBLICATIONS

Stanislav Hodas et al. "Monitoring the Geometric Position of Transition Zones to Increase the Quality and Safety of Railway Lines" Appl. Sci Jun. 14, 2022.*

(Continued)

*Primary Examiner* — Gertrude Arthur Jeanglaude
(74) *Attorney, Agent, or Firm* — Arnold & Porter Kaye Scholer LLP

(57) ABSTRACT

A railcar fouling detection system is disclosed herein that is configured to monitor a railway foul zone between a switch and a foul line by detecting railway vehicles moving within or through the foul zone and determining whether railway vehicles are positioned within the foul zone based on information obtained by the one or more sensors. In some embodiments, the railcar fouling detection system may be configured to determine whether a railway vehicle is positioned within the foul zone by counting the number of wheels (or railway vehicles) entering and exiting the foul zone. The railcar fouling detection system may be configured to provide a visual indication of whether or not a railway vehicle is presently within the foul zone and/or provide a notification to locomotives in response to detecting a railway vehicle positioned within the foul zone.

20 Claims, 4 Drawing Sheets

(56) References Cited

U.S. PATENT DOCUMENTS

| | | | | |
|---|---|---|---|---|
| 8,296,065 | B2 * | 10/2012 | Haynie | B61L 25/025 701/472 |
| 10,272,932 | B2 | 4/2019 | Roberts et al. | |
| 11,192,565 | B2 * | 12/2021 | Roberts | B61L 17/00 |
| 2018/0273066 | A1 * | 9/2018 | Mulligan | B61L 27/57 |
| 2020/0406944 | A1 | 12/2020 | Tubergen | |
| 2023/0060665 | A1 | 3/2023 | Bartek et al. | |

FOREIGN PATENT DOCUMENTS

| | | | |
|---|---|---|---|
| WO | WO 2012/123474 | A1 | 9/2012 |
| WO | WO 2014/182887 | A1 | 11/2014 |

OTHER PUBLICATIONS

International Search Report dated Jun. 26, 2024, issued in Int'l App. PCT/US2024/019140.

* cited by examiner

RAILCAR FOULING DETECTION SYSTEM

RELATED APPLICATIONS

This application claims priority to U.S. Provisional Patent Application No. 63/489,229, "Foul Line Detection System," filed on Mar. 9, 2023, the content of which is hereby incorporated herein by reference in its entirety.

FIELD OF THE DISCLOSURE

The present invention relates to railways and, more particularly, to a system for monitoring a railway foul zone.

BACKGROUND OF THE INVENTION

A railway foul line (or fouling point) is a location on a railroad track prior to which a railcar or other railway vehicle may not be parked without being at risk of being struck or collided with by a railcar or railway vehicle on an adjacent track. The position of foul lines (which may or may not be physically marked on a track) are based on how far apart two tracks are from other after a divergence (i.e., at a switch). To avoid an accident, railcars (or other railway vehicles) must be parked beyond the foul line where the tracks are far enough apart (or, in other words, have diverged sufficiently from a switching point) that a train on the adjacent track will not clip the parked railcar when in operation. As used herein, "railway vehicles" may comprise railcars, locomotives, railcar movers, and/or other vehicles that are configured to move on railroad tracks.

Foul lines are typically marked with foul line markers or indicators that indicate to a locomotive operator or railyard worker a point that any railcars or other railway vehicles must be pulled beyond in order for them to be clear of railcars or other railway vehicles operating on the adjacent track. For example, the entire railroad tie may be painted along with both sides of the web and head of the rail for the width of the tie. In many cases, the foul lines are painted with a bright color to indicate the point past which all railcars or railway vehicles must be pulled before being parked. Railcars or other railway vehicles that are parked before or on the foul line will not necessarily have sufficient clearance and are at risk of causing an accident.

In some cases, the paint on the railroad tie may fade or the marker or indicator otherwise used to indicate the foul line may not be sufficiently visible to locomotive operators or other railroad/railyard personnel. If the paint on the railroad tie fades or the locomotive operator or other railroad/railyard personnel responsible for ensuring a railcar or other railway vehicle is not pulled sufficiently past the foul line is unable to identify the location of the foul line, the potential risk that the railcar or other railway vehicle is not pulled past the foul line obviously increases. If the railcar or other railway vehicle is not pulled past the foul line, there is a serious risk that a collision, derailment, or some other accident will occur, which would prove costly in addition to potentially resulting in serious harm or loss of life for individuals in or around the railway vehicles involved.

Accordingly, there is a need for an improved system or method for monitoring railway foul zones and alerting a locomotive operator or other railroad/railyard personnel when a railcar or other railway vehicle is not pulled sufficiently past a foul line.

SUMMARY OF THE INVENTION

Aspects of this disclosure relate to a railcar fouling detection system installed on a railway and configured to monitor a railway foul zone and provide an alert when a railcar or other railway vehicle is not pulled sufficiently past a foul line. In various embodiments, the railcar fouling detection system may include one or more sensors, a control unit, an indicator light, and/or one or more other components. The one or more sensors may be installed on, between, above, below, and/or adjacent to a set of rails (or a set of tracks) at a location on, adjacent to, or otherwise proximate to a foul line on the rail line comprising the set of rails. The one or more sensors may be configured to determine the position of a railcar (or other railway vehicle) relative to a foul line. For example, the one or more sensors may be configured to determine whether a component of a railcar (such as an end of the railcar or a set of wheels on the railcar) is near, over, beyond, or otherwise on either side of the foul line.

In various embodiments, the railcar fouling detection system may be configured to detect movement of a railcar (or other railway vehicle) on a track at or near a foul line, and determine whether the railcar (or other railway vehicle) has been parked prior to or on the foul line. If railcar fouling detection system determines that the railcar (or other railway vehicle) has been parked prior to or on the foul line, the railcar fouling detection system may be configured to provide an audible and/or visual alert to the locomotive operator and/or other personnel nearby. For example, the railcar fouling detection system may be configured to activate the indicator light to alert locomotive operators and/or other nearby personnel when the railcar fouling detection system determines that a railcar has been parked prior to or on the foul line.

These and other objects, features, and characteristics of the systems and/or methods disclosed herein, as well as the methods of operation and functions of the related elements of structure and the combination thereof, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

The present invention is illustrated by way of example and not limited in the accompanying figures in which like reference numerals indicate similar elements and in which.

Figure 1:
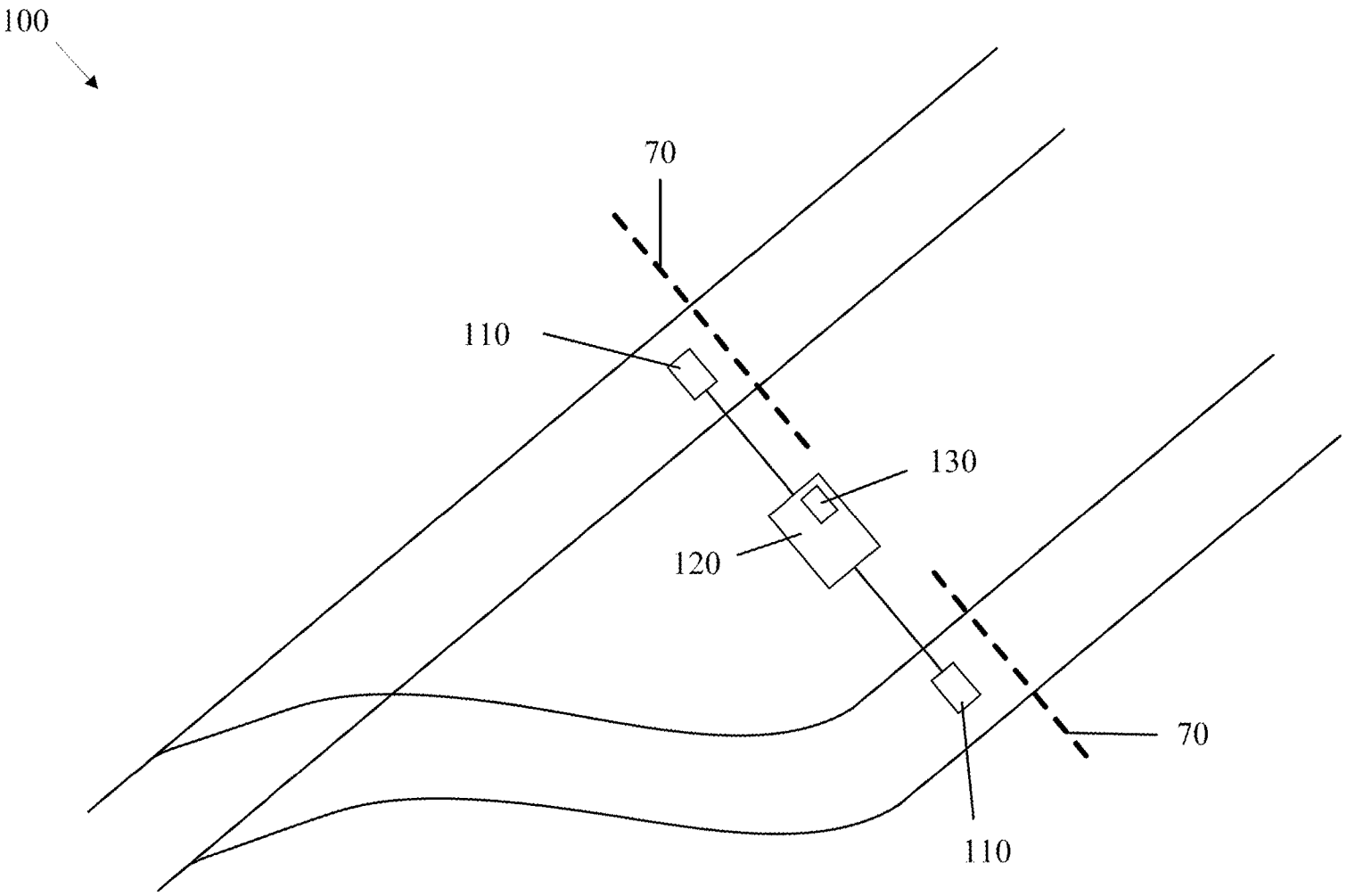
FIG. 1 depicts a top view of an example railcar fouling detection system, according to one or more aspects described herein.

These drawings are provided for purposes of illustration only and merely depict typical or example embodiments. These drawings are provided to facilitate the reader's understanding and shall not be considered limiting of the breadth, scope, or applicability of the disclosure. For clarity and ease of illustration, these drawings are not necessarily drawn to scale.

DETAILED DESCRIPTION

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized, and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three-dimensional orientation of structures in order to fall within the scope of this invention.

The invention described herein relates to a railcar fouling detection system configured to monitor a railway foul zone and provide an alert when a railcar or other railway vehicle is not pulled sufficiently past a foul line. In various embodiments, the railcar fouling detection system may be positioned at or near a foul line for one or a set of railroad lines. In some embodiments, each of the components may be located at or near the railroad rails. In other embodiments, one or more components may be remote from the railroad rails.

As described herein, a "foul zone" (or "critical region") may comprise an area on a track in which cars or other railway vehicles that are parked are at risk of causing a collision (or otherwise contacting) a vehicle on an adjacent track. In various embodiments, the foul zone is a portion of a track (or set of tracks) located between a switch (or switch point) and the foul line, such that the foul line defines a boundary of the foul zone. In some embodiments, the foul zone may encompass the entirety of the track between a switch (or switch point) and the foul line. In other embodiments, the foul zone may encompass only a portion of the track between a switch (or switch point) and the foul line. As a non-limiting example, the foul zone may comprise a portion of a track beginning 10 feet after a switch (or switch point) and ending at a foul line (which may be physically marked and/or simply known to railway personnel and the systems and methods described herein). For convenience, railcars or other railway vehicles are described as within the foul zone when they are positioned prior to or on the foul line. However, a person having ordinary skill in the art would appreciate that this terminology is dependent on the perspective of an individual. For example, railyard personnel concerned with the position of vehicles at the end of a track may refer to a railcar or other vehicle as within the foul zone when the railcar or other vehicle is parked (or otherwise located) beyond, past, or over the foul line and refer to a railcar or other vehicle as safely positioned outside the foul zone when the railcar or other vehicle is parked prior to or inside the foul line. In other words, regardless of the relative terminology used to describe whether a railcar or other vehicle is located within a foul zone, the railcar fouling detection system described herein is configured to determine whether or not a railcar or other vehicle is positioned within a foul zone defined in part by a foul line.

FIG. 1 depicts a top view of an example railcar fouling detection system 100, according to one or more aspects described herein. In various embodiments, railcar fouling detection system 100 may comprise one or more sensors 110, a control unit 120, an indicator light 130, and/or one or more other components. In various embodiments, one or more sensors 110 may be configured to determine whether a component of a railcar (such as an end of the railcar or a set of wheels on the railcar) is near, over, beyond, or otherwise on either side of the foul line. In various embodiments, one or more sensors 110 may be configured to detect movement of a railcar (or other railway vehicle) on a track at or near a foul line, detect when a movement has completed (for example, that a railcar has come to a stop), and/or determine whether the railcar (or other railway vehicle) has stopped or been parked prior to or on the foul line. For example, in some embodiments, one or more sensors 110 may be configured to automatically determine whether a railcar (or other railway vehicle) has stopped or been parked prior to or on the foul line responsive to detecting that movement on the track has stopped.

Figure 2A:
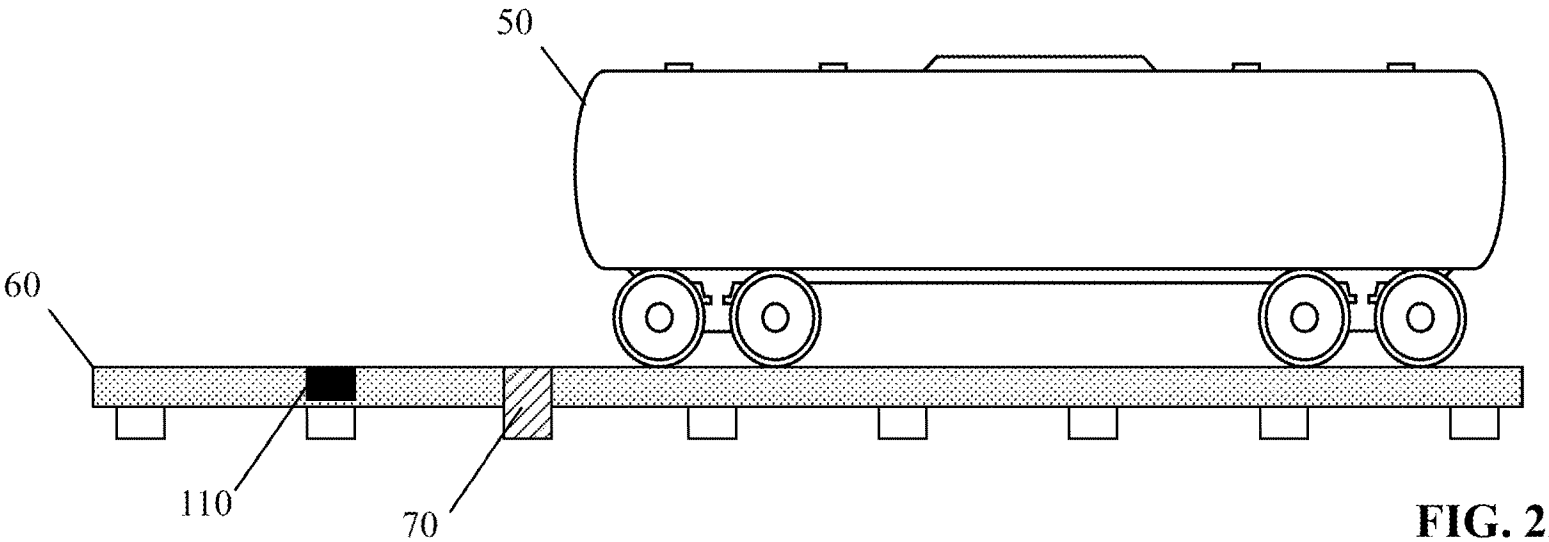
FIGS. 2A-B depict side views of an example railcar fouling detection system in operation, according to one or more aspects described herein.
Figure 2B:
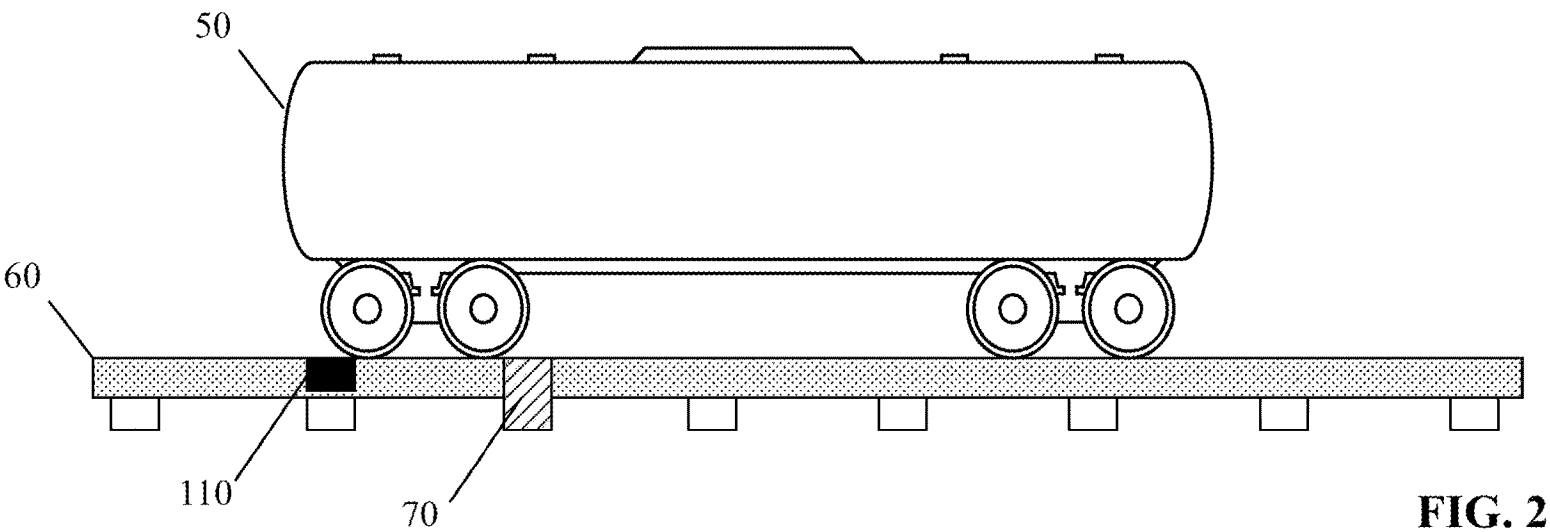

FIGS. 2A-B depict side views of railcar fouling detection system 100 in operation, according to one or more aspects described herein. As described herein, railcar fouling detection system 100 may be configured to detect whether a railcar 50 is parked or stopped on a track 60 in a dangerous position with respect to a foul line 70 of track 60. For example, in various embodiments, one or more sensors 110 associated with foul line 70 and located near, adjacent, or within a vicinity of foul line 70 may be configured to detect whether railcar 50 is parked or stopped on or prior to foul line 70 such that a portion of railcar 50 hangs over foul line 70 and is thus at risk of collision with a passing train on an adjacent track. In FIG. 2A, railcar 50 is not parked or stopped on or prior to foul line 70. Accordingly, one or more sensors 110 will not detect railcar 50 as being in fault. In FIG. 2B, railcar 50 is parked or stopped on or prior to foul line 70. In such a circumstance, one or more sensors 110 will detect railcar 50 as being in fault. In response, railcar fouling detection system 100 may be configured to provide an alert to the locomotive operator or other nearby personnel, for example, by activating indicator light 130.

In various embodiments, one or more sensors 110 may include one or more of radar sensors, ultrasonic sensors, laser sensors, inductive sensors, photocell-based sensors, electro-mechanical sensors, electromagnetic sensors (such as Hall sensors), proximity sensors, capacitive sensors, and/or other types of sensors configured to determine (or provide information indicating) the position of a railcar (or other railway vehicle) relative to a foul line. In some embodiments, one or more sensors 110 may comprise electromagnetic sensors configured to generate an electromagnetic field that emits via an opening in a component of railcar fouling detection system 100. In some embodiments, the one or more sensors 110 may be configured to detect ferrous metal targets (e.g., a moving train wheel) without physically contacting the target. For example, movement of the train wheel near one or more sensors 110 may disrupt the electromagnetic field, causing one or more sensors 110 to detect the movement of the train wheel.

In various embodiments, one or more sensors 110 may be configured to detect movement on the track and trigger the one or more operations described herein. For example, by only detecting the position of railcars (or other railway vehicles) relative to foul line 70 when movement near foul line 70 is detected, railcar fouling detection system 100 is able to conserve power. More particularly, in some embodiments, when movement near foul line 70 is not detected, one or more operations of railcar fouling detection system 100 are suspended and/or one or more components of railcar fouling detection system 100 are powered off in order to conserve power. In some embodiments, the same set of one or more sensors 110 used to detect whether railcar 50 is parked or stopped on or prior to foul line 70 may also be used to detect movement of railcar 50 (or another railway vehicle) and detect when a movement has completed (for example, that a railcar has come to a stop). In other embodiments, one or more sensors 110 may include a first set of sensor(s) configured detect movement of railcar 50 (or another railway vehicle) and another set of sensor(s) configured to detect whether railcar 50 is parked or stopped on or prior to foul line 70. For example, in some embodiments, a first set of one or more sensors located a predefined distance from foul line 70 (e.g., 5 to 10 feet from foul line 70) may be used to detect movement of a railcar (or other railway vehicle) on track 60 and, in response to detecting that movement has stopped, cause (or trigger) a second set of one or more sensors located closer to foul line 70 to detect whether a railcar (or other railway vehicle) is parked or stopped on or prior to foul line 70. In some embodiments, the one or more sensors 110 used to detect movement of railcar 50 (or another railway vehicle) (or lack thereof) may include one or more of accelerometer/IMU-based sensors, electro-mechanical switches, electromagnetic sensors, photocell-based sensors, proximity sensors, capacitive sensors, axle counters and/or other sensors configured to detect a train moving towards, near, or at a foul line. In some embodiments, the first set of one or more sensors may be positioned on or adjacent to the same set of rails (or track) as the foul line. In other embodiments, the first set of one or more sensors may be positioned before a switch point for a set of tracks that include the track with the foul line.

In some embodiments, the one or more sensors 110 used to detect movement of a railcar (or other railway vehicle) (or lack thereof) and/or the one or more sensors 110 used to detect whether a railcar (or other railway vehicle) is parked or stopped on or prior to a foul line may comprise sensors the same as or similar to train wheel sensors 140 described in U.S. patent application Ser. No. 17/900,747, entitled "Switch Gap Detection System," filed Aug. 31, 2022, the content of which is hereby incorporated by reference herein in its entirety.

In some embodiments, one or more sensors 110 may be affixed to a rail via a sensor mounting. In various embodiments, one or more sensors 110 may be included within an electronic housing that is affixed to the sensor mounting. In some embodiments, the sensor mounting may include a base plate configured to be installed beneath the rail and/or using one or more reinforcing components configured to secure the sensor mounting to the rail.

In some embodiments, one or more sensors 110 may include a first set of sensors for one track and a second set of sensors for an adjacent track. For example, a lead track may, after a switch (or switch point), split into two separate tracks. In such a situation, a foul zone for one track may correspond to a foul zone for the other track. Put differently, the foul zone for one track may also be the foul zone for the adjacent track, as the area on the tracks in which cars or other railway vehicles that are parked are at risk of causing a collision (or otherwise contacting) a vehicle on the adjacent track may be jointly defined as the portions of the set of tracks between the switch (or switch point) and a foul line that traverses both tracks (as depicted, for example, in FIG. 3, described further herein).

In various embodiments, control unit 120 may include one or more processors configured to provide information processing capabilities in railcar fouling detection system 100. For example, while referred to herein as determined by one or more sensors 110, control unit 120 may be configured to detect movement on the track and/or determine whether a railcar or other vehicle is located within a foul zone based on information (or data) obtained by one or more sensors 110 and provided to control unit 120. In some embodiments, control unit 120 may be positioned on or adjacent to a track. In some embodiments, control unit 120 may be positioned between a set of tracks and configured to determine whether a railway vehicle parked or positioned on either of the set of tracks is within a foul zone. In various embodiments, control unit 120 may be configured to cause one or more other operations to be performed, for example, in response to information provided to control unit 120 by one or more sensors 100. For example, control unit 120 may be configured to cause railcar fouling detection system 100 to provide one or more of audible alerts, visual alerts, provide input or instructions to cause one or more actions associated with a train and/or foul line as described herein, relay information to a train and/or one or more other remote entities (e.g., a cloud database), and/or provide other outputs. For example, in various embodiments, control unit 120 may be configured to cause indicator light 130 to be turned on, or cause an audible alarm to sound, when railcar fouling detection system 100 detects that a railcar (or other railway vehicle) has stopped or been parked prior to or on the foul line.

In various embodiments, railcar fouling detection system 100 may be configured (e.g., via control unit 120) to communicate with individual railway vehicles, systems, and/or remote entities using radio, cellular, internet, and/or other communication technology now known or future developed. In various embodiments, railcar fouling detection system 100 may be configured to interface with various railyard or railway systems in order to automate one or more operations or processes associated with the railyard or railway system. In various embodiments, railcar fouling detection system 100 may include a transmitter and/or other device configured to transmit signals or information to a locomotive and/or other systems or entities as described herein. For example, control unit 120 may be configured to interface with a locomotive and/or other systems or entities described herein by causing a signal or information to be transmitted via the transmitter.

In various embodiments, control unit 120 and/or other components of railcar fouling detection system 100 may be battery-powered components, for example, to enable them to be placed remotely on the tracks without having to run power to the location at which railcar fouling detection system 100 is positioned. In some embodiments, control unit 120 and/or other components of railcar fouling detection system 100 may be powered using power wired directly to, or a location accessible by, railcar fouling detection system 100 instead of or in addition to battery power or one or more other techniques described herein. For example, control unit 120 and/or other components of railcar fouling detection system 100 may be powered off of 120V wall power in addition to or instead of via a battery. In some embodiments, control unit 120 and/or one or more other components of railcar fouling detection system 100 may include solar power panels configured to provide operating power to the component(s). In some embodiments, control unit 120 and/ or other components of railcar fouling detection system 100 may be configured to include data storage capabilities. For example, in some embodiments, a processor of control unit 120 may be configured to store data related to the operation of railcar fouling detection system 100. In some embodiments, the stored data may then be uploaded to an internet cloud database to be analyzed and reviewed as needed.

In various embodiments, a status of indicator light 130 may change to reflect the current status of foul line 130 (e.g., whether or not a railcar or other railway vehicle is presently in fault (i.e., within the foul zone), whether or not one or more components of railcar fouling detection system 100 are operating as intended, and/or other information indicating a status of railcar fouling detection system 100). In various embodiments, indicator light 130 may include one or more LEDs and/or an LED-based display. In some embodiments, indicator light 130 may include one or more LED lights mounted in a secure housing located adjacent to the rail. In some embodiments, an indicator light 130 and/or one or more other display components of railcar fouling detection system 100 may be configured to display or otherwise indicate a distance from a train wheel to foul line 70. In some embodiments, indicator light 130 may be customizable by software and/or programming to indicate other features and other information as recognized as pertinent to the operation of railcar fouling detection system 100 and/or one or more other features or functionality described herein.

The components of railcar fouling detection system 100 may be placed, mounted, installed, or otherwise positioned on, adjacent to, near, or otherwise proximate to a foul line on a railroad track. In various embodiments, the components of railcar fouling detection system 100 may be mounted to the rail or structures nearby using any appropriate mounting means now known or future developed. For example, in some embodiments, one or more sensors 110 may be positioned before, at (or in-line with), and/or after the foul line. In some embodiments, one or more sensors 110 may be affixed beneath, between, above, on one side, and/or on either side of the rails. In other words, one or more sensors 110 may be installed in any manner within keeping in the spirit of the invention so long as the sensors are able to perform the operations described herein as would be understood by a person having ordinary skill in the art. In exemplary embodiments, one or more sensors 110 may be positioned on the foul line between (or in the middle of) a set of rails comprising a track, before the foul line, after the foul line, between the tracks at a switch point proximate to the foul line, above the tracks, on both sides of the rail(s), clamped to the rail, or otherwise positioned on a track (i.e., on or within a set of rails comprising the track), near a track (e.g., above or below a track), or adjacent to a track (e.g., on either side of track or a set of tracks, including between a set of tracks).

In various embodiments, the one or more components of railcar fouling detection system 100 may be communicatively connected to each other directly and/or indirectly via control unit 120. In various embodiments, railcar fouling detection system 100 may be configured to communicate with a locomotive (or another railway vehicle) via a receiver located on the locomotive. For example, the receiver may comprise a 900 MHz radio configured to communicate with control unit 120 and/or one or more other components of railcar fouling detection system 100.

In some embodiments, railcar fouling detection system 100 (or control unit 120) may be configured to cause an audible alarm to sound in response to detecting a railcar (or other railway vehicle) is parked or stopped within a foul zone. In some embodiments, railcar fouling detection system 100 (or control unit 120) may be configured to transmit a signal to a locomotive (or other railway vehicle) that causes a notification to be provided within the locomotive (or other railway vehicle) indicating that a railcar (or other railway vehicle) is parked or stopped within a foul zone. For example, railcar fouling detection system 100 (or control unit 120) may be configured to cause an audible and/or visual alarm to be provided within the locomotive (or other railway vehicle) in response to detecting that a railcar (or other railway vehicle) is parked or stopped within a foul zone.

In various embodiments, railcar fouling detection system 100 may be configured to communicate with a locomotive relay to activate locomotive brakes, and/or one or more other components or features to either allow a locomotive to pass a foul line or cause a locomotive to brake prior to reaching a foul line without requiring communication with the locomotive operator. For example, if one or more sensors 110 of railcar fouling detection system 100 detect a train approaching a portion of an adjacent track (or control unit 120 otherwise determines that a train is approaching the portion of the adjacent track) when a railway vehicle is parked or stopped on or prior to a foul line, a notification may be provided to an operator of the oncoming train to inform the train operator that a vehicle is parked or stopped in a position that may cause an accident with the train. For example, the notification may comprise an audible alert, a visual alert, and/or a radio signal transmitted to the train. In some embodiments, railcar fouling detection system 100 may be configured to automatically stop the train to prevent an accident. For example, railcar fouling detection system 100 may be configured to send a signal to the train to cause the train to stop automatically. In some embodiments, the signal to stop the train may be sent responsive to a determination that proper action has not been taken manually before the train is within a predefined distance of the foul line. For example, if the train comes within a predefined distance of a specific location on the adjacent track and proper action has not been taken, a signal may be sent to the train to stop the train automatically (e.g., without requiring authorization or other input from the train operator). In some embodiments, the oncoming train (or locomotive) may be outfitted with a system configured to automatically stop the train or locomotive based on input from a remote source. In such embodiments, railcar fouling detection system 100 may be configured to send a signal to that system to cause the oncoming train to automatically stop without requiring communication with the train operator. For example, in some embodiments, railcar fouling detection system 100 may be configured to interface with an emergency action system (or device) as described in U.S. patent application Ser. No. 15/133,935, entitled "Anti-Collision Device and System for Use with a Rail Car," filed Apr. 20, 2016, the content of which is hereby incorporated by reference herein in its entirety.

Figure 3:
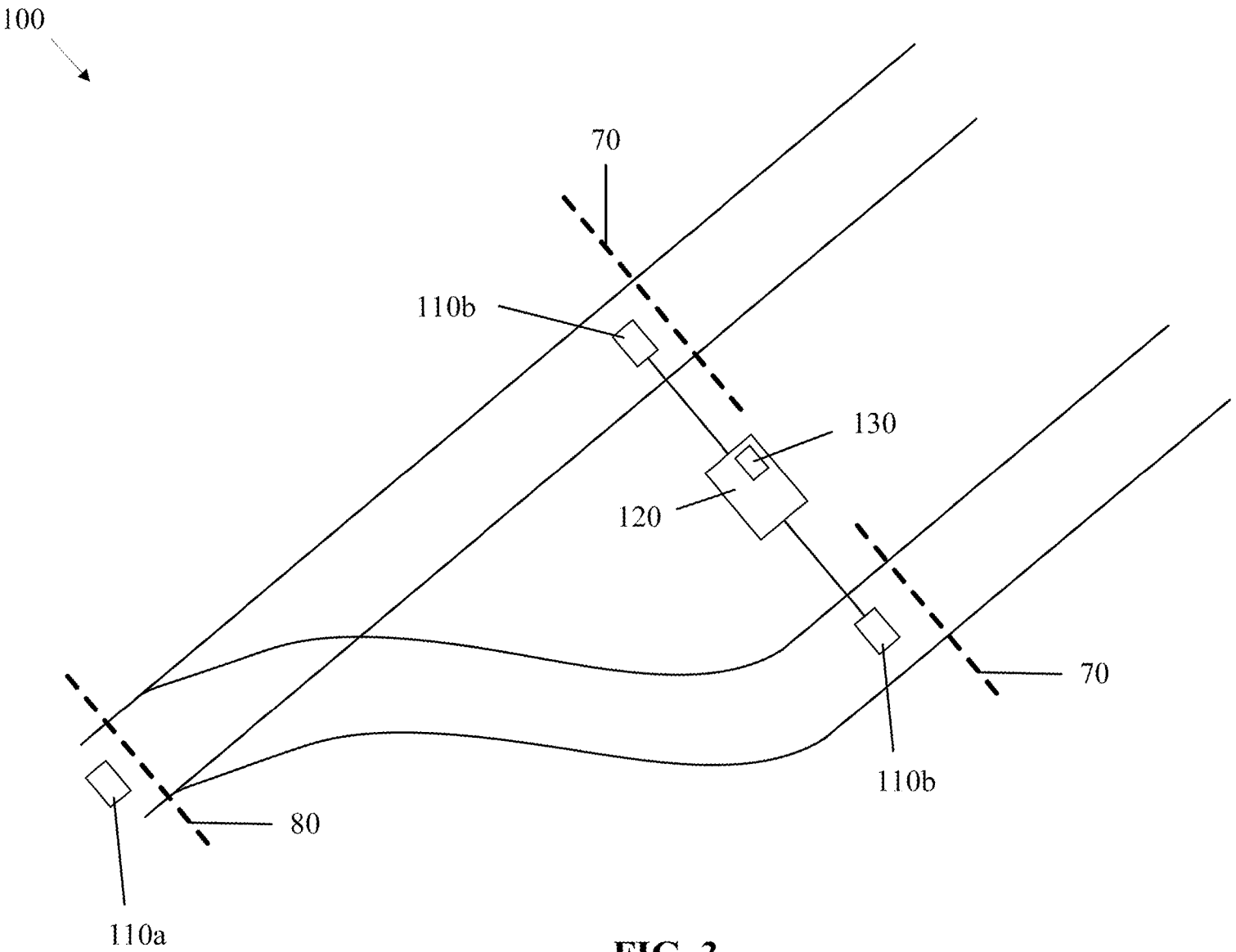
FIG. 3 depicts another top view of an example railcar fouling detection system, according to one or more aspects described herein.

FIG. 3 depicts another top view of an example railcar fouling detection system 100, according to one or more aspects described herein. In some embodiments, railcar fouling detection system 100 may include one or more sensors 110 that are positioned or configured to monitor each end of a foul zone. For example, the one or more sensors 110 of railcar fouling detection system 100 may include one or more sensors 110*a* configured to monitor a lead track at or prior to a switch and one or more sensors 110*b* configured to monitor foul line 70 (as described herein). In some embodiments, one or more sensors 110*a* may be configured to monitor a predefined portion of the lead track, which may be referred to herein and depicted in FIG. 3 as trigger line 80. Together, trigger line 80 and foul line(s) 70 may define the boundaries of the foul zone. In an embodiment including one or more sensors 110*a* and one or more sensors 110*b*, railcar fouling detection system 100 may be configured to determine whether a railcar or other vehicle is located within a foul zone based on information obtained by one or more sensors 110*a* and one or more sensors 110*b*. In an example embodiment, one or more sensors 110*a* may be configured to detect whether a railcar or other railway vehicle has passed trigger line 80 and thus entered (or exited) the foul zone, and one or more sensors 110*b* may in turn be configured to detect whether a railcar or other railway vehicle has passed foul line 70, and thus exited (or entered) the foul zone. In such embodiments, railcar fouling detection system 100 may be configured to determine whether a railcar or other vehicle is located within a foul zone based on whether each railcar or other railway vehicle that entered the foul zone also exited the foul zone. In some embodiments, one or more sensors 110*a* and one or more sensors 110*b* may be configured to count the number of wheels that enter and exit the foul zone. The number of wheels entering should always be equal to the number of wheels exiting the foul zone. If there is a mismatch in the number entering and exiting, there must be a car still partially or fully parked in the foul zone (and therefore in the foul). In some embodiments, one or more sensors 110*a* and one or more sensors 110*b* may include Hall effect sensors positioned nearby wheel flanges on an inside of the track as the railcar or other railway vehicle passes each respective sensor.

Figure 4:
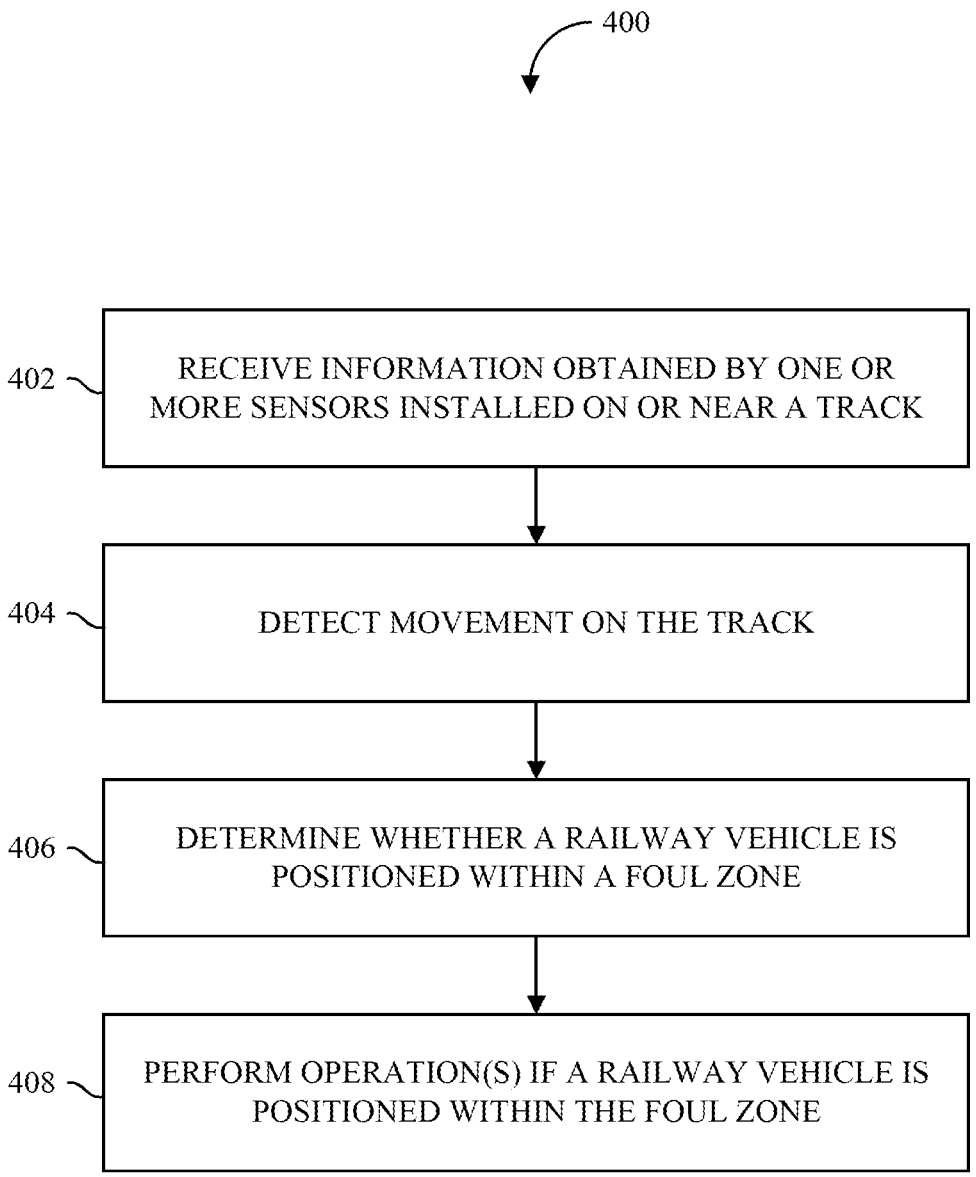
FIG. 4 illustrates an example of a process for monitoring a railway foul zone, according to one or more aspects described herein.

FIG. 4 illustrates an example of a process 400 for monitoring a railway foul zone, according to one or more aspects described herein. The operations of process 400 presented below are intended to be illustrative and, as such, should not be viewed as limiting. In some implementations, process 400 may be accomplished with one or more additional operations not described, and/or without one or more of the operations discussed. In some implementations, two or more of the operations of process 400 may occur substantially simultaneously. The described operations may be accomplished using some or all of the system components described in detail above. In various embodiments, process 400 may be performed using some or all of the components of railcar fouling detection system 100 described herein. For example, the functionality described with respect to process 400 may be performed by a control unit 120 of railcar fouling detection system 100.

In an operation 402, process 400 may include receiving information obtained by the one or more sensors. In various embodiments, the one or more sensors may be installed proximate to a foul zone, wherein the foul zone comprises a portion of a track between a switch point and a foul line. For example, the one or more sensors may include one or more radar sensors, ultrasonic sensors, laser sensors, inductive sensors, photocell-based sensors, electro-mechanical sensors, electromagnetic sensors, proximity sensors, capacitive sensors, and/or other types of sensors. In various embodiments, the one or more sensors may be installed on or between a set of rails comprising the track, above or below the track, and/or on either side of the track.

In an operation 404, process 400 may include detecting movement on the track based on information obtained from the one or more sensors. In various embodiments, process 400 may not include operation 404. In some embodiments, however, process 400 may move to operation 406 only once movement on the track is detected in operation 404. For example, a railcar fouling detection system may be configured to begin detecting whether a railway vehicle is positioned within the foul zone in response to detecting movement on the track. In some embodiments, one or more components of a railcar fouling detection system may be caused to power off when movement on the track is not detected.

In an operation 406, process 400 may include determining whether a railway vehicle is positioned within the foul zone based on information obtained by the one or more sensors. In various embodiments, determining whether a railway vehicle is positioned within the foul zone may comprise determining whether any portion of a railway vehicle is parked beyond the foul line. In some embodiments, the one or more sensors may include two or more sets of one or more sensors, and determining whether a railway vehicle is positioned within the foul zone may comprise determining when a railway vehicle enters the foul zone based on information obtained by one set of one or more sensors and determining whether the railway vehicle exits the foul zone based on information obtained by another set of one or more sensors. In such embodiments, the information obtained by the first set of one or more sensors may indicate a number of wheels entering the foul zone, and the information obtained by the second set of one or more sensors may indicate a number of wheels exiting the foul zone. In such implementations, the first set of one or more sensors may be positioned proximate one end of the foul zone, and the second set of one or more sensors may be positioned proximate the other end of the foul zone. In some embodiments, the one or more sensors may include at least one set of sensors for the track and at least one other set of sensors for an adjacent track. In such embodiments, operation 406 may include determining whether a railway vehicle on either the track or the adjacent track is positioned within the foul zone based on information obtained by the one or more sensors.

In some embodiments, the one or more sensors may include two or more sets of one or more sensors, and movement on the track may be detected (in operation 404) based on information obtained by one set of one or more sensors and whether a railway vehicle is positioned within the foul zone may be determined (in operation 406) based on information obtained by the other set of one or more sensors. In such embodiments, the first set of one or more sensors may be positioned before the switch point, and the second set of one or more sensors may be positioned closer to the foul line than the first set of one or more sensors.

In an operation 408, process 400 may include performing one or more operations in response to determining that a railway vehicle is positioned within the foul zone. For example, in some embodiments, the one or more operations may include causing a visual indication of whether or not a railway vehicle is presently within the foul zone to be provided via an indicator light. In some embodiments, the indicator light may be mounted in a secure housing located adjacent to the track. In some embodiments, the one or more operations may include causing an audible alarm to sound. In some embodiments, the one or more operations may include providing a notification to a locomotive. For example, the one or more operations may include transmitting a signal to a locomotive that causes an audible or visual alarm to be provided within the locomotive. In some embodiments, the one or more operations may include sending a signal to a train causing the train to stop automatically. For example, the signal may be sent to a device on the train that, upon receiving the signal, causes air to be released from a brake pipe, thereby applying a set of brakes on the train. In some embodiments, the signal sent to the train may cause the train to stop without requiring communication with a locomotive operator.

It is to be understood that the invention is not limited in its application to the details of construction and the arrangement of the components set forth herein. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

While the preferred embodiments of the invention have been shown and described, it will be apparent to those skilled in the art that changes and modifications may be made therein without departing from the spirit of the invention, the scope of which is defined by this description.

Reference in this specification to "one embodiment", "an embodiment", "some embodiments", "various embodiments", "certain embodiments", "other embodiments", "one series of embodiments", or the like means that a particular feature, design, structure, or characteristic described in connection with the embodiment is included in at least one embodiment of the disclosure. The appearances of, for example, the phrase "in one embodiment" or "in an embodiment" in various places in the specification are not necessarily all referring to the same embodiment, nor are separate or alternative embodiments mutually exclusive of other embodiments. Moreover, whether or not there is express reference to an "embodiment" or the like, various features are described, which may be variously combined and included in some embodiments, but also variously omitted in other embodiments. Similarly, various features are described that may be preferences or requirements for some embodiments, but not other embodiments.

The language used herein has been principally selected for readability and instructional purposes, and it may not have been selected to delineate or circumscribe the inventive subject matter. Other embodiments, uses and advantages of the invention will be apparent to those skilled in the art from consideration of the specification and practice of the invention disclosed herein. The specification should be considered exemplary only, and the scope of the invention is accordingly intended to be limited only by the following claims.

What is claimed is:

1. A railcar fouling detection system comprising:

one or more sensors installed proximate to a foul zone, wherein the foul zone comprises a portion of a track located between a switch point and a foul line in which railway vehicles are at risk of causing a collision with a vehicle on an adjacent track;

a control unit configured to determine whether a railway vehicle is positioned within the foul zone based on information obtained by the one or more sensors; and an indicator light configured to provide a visual indication responsive to a determination that the railway vehicle is presently within the foul zone.

2. The railcar fouling detection system of claim 1, wherein the one or more sensors include one or more radar sensors, ultrasonic sensors, laser sensors, inductive sensors, photocell-based sensors, electro-mechanical sensors, electromagnetic sensors, proximity sensors, and/or capacitive sensors.

3. The railcar fouling detection system of claim 1, wherein the one or more sensors are installed on or between a set of rails comprising the track, above or below the track, and/or on either side of the track.

4. The railcar fouling detection system of claim 1, wherein to determine whether a railway vehicle is positioned within the foul zone, the control unit is configured to determine whether any portion of a railway vehicle is parked beyond the foul line.

5. The railcar fouling detection system of claim 1, wherein the control unit is further configured to detect movement on the track based on information obtained by the one or more sensors.

6. The railcar fouling detection system of claim 5, wherein the control unit is configured to cause one or more components of the railcar fouling detection system to power off when movement on the track is not detected.

7. The railcar fouling detection system of claim 5, wherein the control unit is configured to begin detecting whether a railway vehicle is positioned within the foul zone in response to detecting movement on the track.

8. The railcar fouling detection system of claim 5, wherein the one or more sensors include a first set of one or more sensors and a second set of one or more sensors, wherein the control unit is configured to detect movement on the track based on information obtained by the first set of one or more sensors and determine whether a railway vehicle is positioned within the foul zone based on information obtained by the second set of one or more sensors.

9. The railcar fouling detection system of claim 8, wherein the first set of one or more sensors are positioned before the switch point, and the second set of one or more sensors are positioned closer to the foul line than the first set of one or more sensors.

10. The railcar fouling detection system of claim 1, wherein the indicator light is mounted in a secure housing located adjacent to the track.

11. The railcar fouling detection system of claim 1, wherein the one or more sensors include a first set of sensors for the track and a second set of sensors for an adjacent track.

12. The railcar fouling detection system of claim 11, wherein the control unit is configured to determine whether a railway vehicle on either the track or the adjacent track is positioned within the foul zone based on information obtained by the one or more sensors.

13. The railcar fouling detection system of claim 1, wherein the control unit is configured to cause an audible alarm to sound in response to detecting a railway vehicle positioned within the foul zone.

14. The railcar fouling detection system of claim 1, wherein the control unit is configured to provide a notification to a locomotive in response to detecting a railway vehicle positioned within the foul zone.

15. The railcar fouling detection system of claim 14, wherein to provide the notification to the locomotive, the control unit is configured to transmit a signal causing an audible or visual alarm to be provided within the locomotive in response to detecting a railway vehicle positioned within the foul zone.

16. The railcar fouling detection system of claim 1, wherein the one or more sensors include a first set of one or more sensors and a second set of one or more sensors, wherein to determine whether a railway vehicle is positioned within the foul zone, the control unit is configured to:

determine when a railway vehicle enters the foul zone based on information obtained by the first set of one or more sensors; and determine whether the railway vehicle exits the foul zone based on information obtained by the second set of one or more sensors.

17. The railcar fouling detection system of claim 16, wherein the information obtained by the first set of one or more sensors indicates a number of wheels entering the foul zone, and the information obtained by the second set of one or more sensors indicates a number of wheels exiting the foul zone.

18. The railcar fouling detection system of claim 1, wherein the control unit is further configured to send a signal to a train causing the train to stop automatically in response to detecting a railway vehicle positioned within the foul zone.

19. The railcar fouling detection system of claim 18, wherein to send the signal to the train, the control unit is configured to send the signal to a device on the train that, upon receiving the signal, causes air to be released from a brake pipe, thereby applying a set of brakes on the train.

20. The railcar fouling detection system of claim 18, wherein the signal sent to the train causes the train to stop without requiring communication with a locomotive operator.

* * * * *